United States Patent [19]

Partridge et al.

[11] 4,156,956

[45] Jun. 5, 1979

[54] FOLDABLE CARDBOARD CASKET

[75] Inventors: Roger J. Partridge, Tipton, Mich.; James S. Callaway, Neopolian, Ohio

[73] Assignees: Austin A. Partridge; Viola M. Partridge, both of Tipton, Mich.

[21] Appl. No.: 845,005

[22] Filed: Oct. 25, 1977

[51] Int. Cl.[2] ..... A61G 17/00

[52] U.S. Cl. ..... 27/4

[58] Field of Search ..... 27/2, 3, 4; 229/16 R, 229/31 R, 41 R

[56] References Cited

U.S. PATENT DOCUMENTS

| | | | |
|---|---|---|---|
| 3,574,906 | 4/1971 | Rittenhouse | 27/4 |
| 3,729,786 | 5/1973 | Walding | 27/3 |
| 4,123,831 | 11/1978 | Covington | 27/4 X |

*Primary Examiner*—John D. Yasko

*Attorney, Agent, or Firm*—Cullen, Sloman, Cantor, Grauer, Scott, & Rutherford

[57] ABSTRACT

A casket includes a container and a removable cover with the container and cover comprising elongated blanks made of double wall corrugated cardboard. Each blank is scored and precut to define, when folded, the aforesaid container and cover respectively, top and bottom walls, upturned and downturned outwardly tapered side walls, upturned and downturned outwardly tapered end walls, and foldable inwardly directed flaps on all said end walls. The flaps register with the corresponding side walls of the container and cover and are secured thereto by an adhesive layer. The cover side and end walls overly and supportably and retainingly engage the corresponding container side and end walls. The cover is snap-fastened and secured to the container by a pair of outwardly directed cut out tabs formed in the end walls of said cover, each defining an anchor stop. The cover anchoring tabs extend downwardly and outwardly from the container end walls and are snap-fitted into and interlocked with the cover anchor stops. A head rest of corrugated cardboard is mounted within said container upon its bottom wall and is of triangular cross section, having a base and converging sides with a triangular notch formed within upper portions of said sides. A sheet of material may be adhered upon one side of each blank, having a wood grain appearance.

10 Claims, 7 Drawing Figures

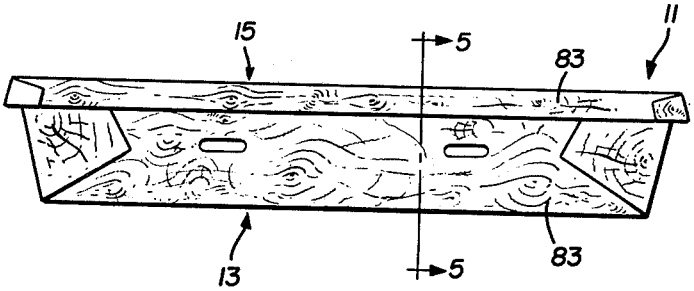
FIG. 1
FIG. 5
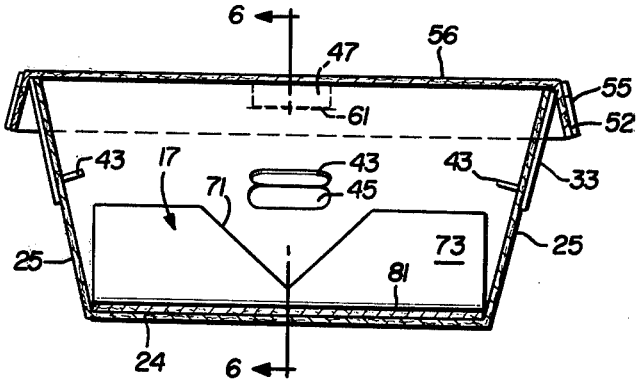
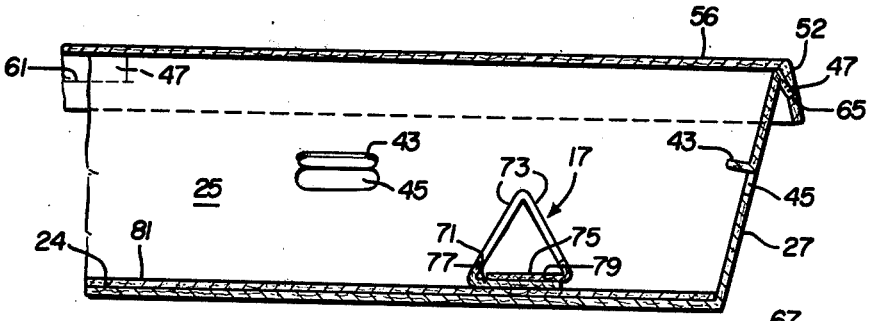
FIG. 6
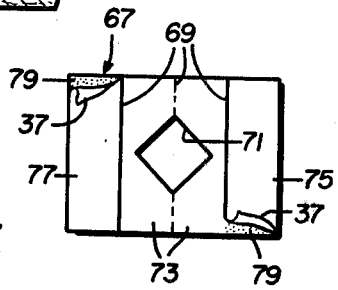
FIG. 7

FOLDABLE CARDBOARD CASKET

BACKGROUND OF THE INVENTION

Heretofore, various efforts have been made to provide an inexpensive light weight and sturdy burial casketor a casket which is completely consumable such as might be employed for cremations, though not limited thereto.

Heretofore, caskets have been constructed of cardboard but have been so complicated in construction and so involved in assembly as to render them costly and impractical. Examples of such prior art efforts to provide a cardboard casket are shown in the following U.S. Patents:

U.S. Pat. No. 3,969,798
U.S. Pat. No. 3,490,114.

Other examples of cardboard containers having a base and and an overlying cover are shown in the following Patents:

U.S. Pat. No. 3,949,933
U.S. Pat. No. 2,304,362
U.S. Pat No. 3,342,401
U.S. Pat. No. 3,325,084
U.S. Pat. No. 1,352,833
U.S. Pat. No 3,917,155.

SUMMARY OF THE INVENTION

It is an object of the present invention to provide a casket which includes a container and a removable cover securable thereover made from blanks of double wall corrugated cardboard so scored, precut and folded as to define the container and removable cover and to include means for snap locking and securing the cover over said container.

It is another object to provide a casket with a container and cover made from double strength corrugated cardboard and wherein, the downturned side and end walls of the cover supportably and retainingly engage the corresponding side and end walls of the container.

It is a further object to provide a casket having a separable container and cover, each defined by blanks which are suitably scored and precut and can be nested together for convenience, for storage and for shipping in unfolded condition.

It is another object to provide a notched head rest for mountable within the casket container adjacent one end wall and secured therein and including a centrally disposed triangular notch.

It is another object to provide a completely sealed and leak-proof casket with the container and the cover respectively formed of one piece.

It is a further object to provide a casket which is completely assembled without the use of any fasteners or metallic elements and which is completely consumable.

These and other objects will be seen from the following specification and claims in conjunction with the appended drawings.

THE DRAWINGS

FIG. 1 is a side elevational view of the present casket.

FIG. 5 is a section on an increased scale taken in the direction of arrows 5—5 of FIG. 1.

FIG. 6 is a fragmentary section taken in the direction of arrows 6—6 of FIG. 5.

FIG. 7 is a plan view of the prescored head rest blank.

It will be understood that the above drawings illustrate merely a preferred embodiment of the invention, and that other embodiments are contemplated within the scope of the claims hereafter set forth.

DETAILED DESCRIPTION OF THE INVENTION

Figure 2:
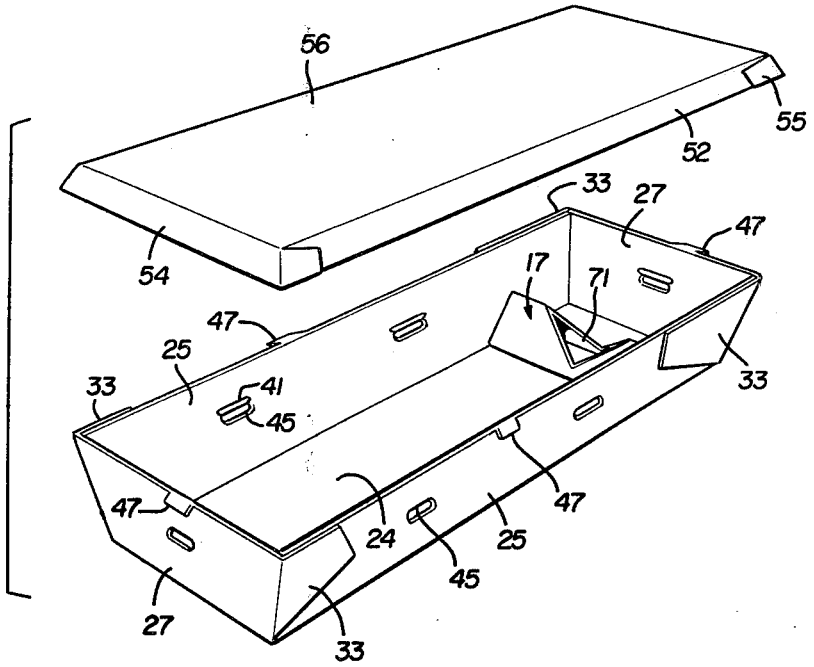
FIG. 2 is an exploded perspective view of the casket container and cover therefor.

The present casket is shown in side view, FIG. 1, as including container 13 and removable cover 15 and as including within said container adjacent one end thereof, head rest 17 of triangular cross section, all as best illustrated in the exploded view, FIG. 2.

Figure 4:
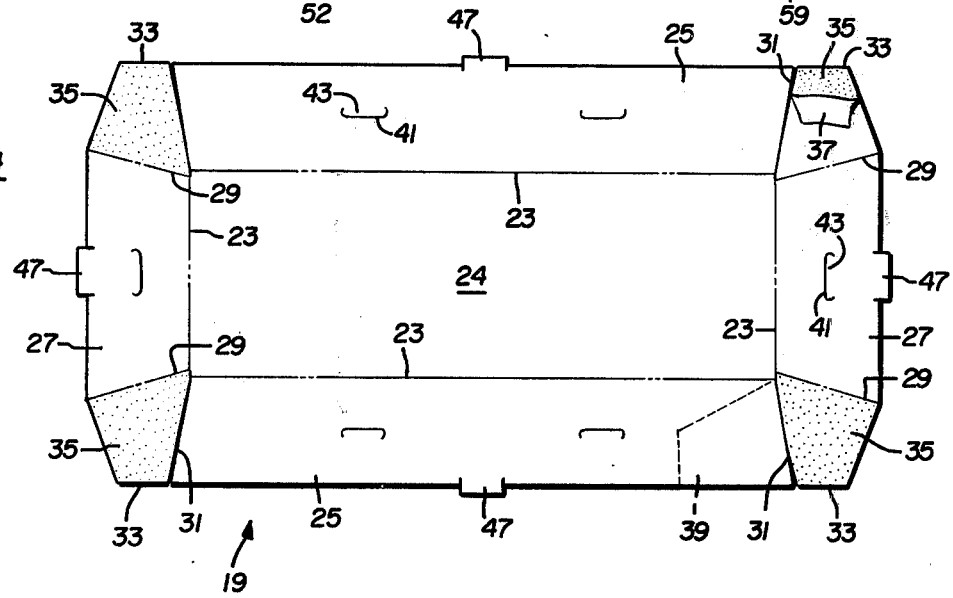
FIG. 4 is a plan view of the precut and scored container blank.

The container is defined by the elongated container blank 19, FIG. 4, formed of a double wall corrugated cardboard which, in illustrative embodiment, is of 350 pound strength and is of a double wall construction. The cover 15 is defined by an elongated cover blank 21 also constructed of a double wall corrugated cardboard of 350 pound strength.

Referring to FIG. 4, the container blank includes score lines 23 or fold lines which, when folded, will define the container bottom wall 24, upturned outwardly directed side walls 25 and upwardly and outwardly directed end walls 27.

The additional score lines 29 formed in said end walls along with the transverse angular cuts 31 provide on folding, the assembly flaps 33 adapted for cooperative registry with the corresponding side walls of the container, as in FIG. 2.

As best shown in FIG. 4, each of the assembly flaps 33 have thereover a pressure-sensitive adhesive layer 35 protectively covered by the tear off strip 37.

A corresponding adhesive layer 39, as shown in dash lines in FIG. 4, is applied to the adjacent end portions of the side walls 25 of the container upon the exterior thereof for cooperative registry adhesive to adhesive, when assembled, FIG. 2.

A series of U-shaped die cuts are formed at 41 within the blank along the side wall portions thereof and centrally of the end walls 27 to define when folded, the inwardly directed flaps 43 as shown in FIG. 6 to provide a series of support recesses 45 to facilitate carrying of the assembled casket when enclosing a human or an animal.

At opposite ends of the blank shown in FIG. 4 centrally of the end walls 27, and centrally of the side walls, are pairs of outwardly extending rectangular cover anchor tabs 47 which, in use, are downturned outwardly, FIGS. 5 and 6.

Figure 3:
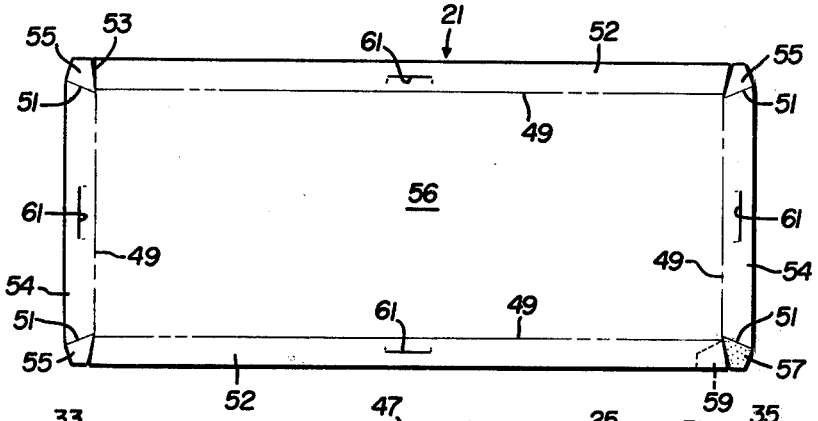
FIG. 3 is a plan view of the prescored and cut cover blank.

Referring to FIG. 3, the cover blank 21 has formed therein a series of score lines 49 or fold lines to thus define a flat cover top 56, cover side walls 52 and cover end walls 54.

The cover blank 21 additionally includes the angular score and fold lines 51 and adjacent thereto, the corresponding slits 53 defining at opposite ends of the cover end walls 54, a series of assembly flaps 55.

As above described with the container 13, each of the assembly flaps 55 have applied thereto a layer of pressure-sensitive adhesive 57 which is protectively covered by a tear off strip the same as at 37, FIG. 4

Corresponding outer end wall portions of the cover side walls have similarly arranged adhesive layers 59, FIG. 3. Thus, the adhesive layers register with each other when the cover elements have been folded as shown in FIG. 2.

Central portions of the cover end walls 54 have U-shaped cuts 61 formed in said blanks to define on proper folding, the outwardly directed flaps 63 which define within said cut out portions the anchor stops 65.

Upon assembly of the cover over the container, FIGS. 5 and 6, the downturned container end and side wall tabs 47 will snap into the four cover slots defined by cuts 61 and retainingly engage the four anchor stops 65. This is a snap action and wherein, the cover 15, once assembled over the container 13, is secured thereto and may not be accidentally removed.

The head rest 17 shown in FIGS. 2 and 6 is formed from the head rest blank 67, FIG. 7, and consists of a rectangular strip of corrugated cardboard, preferably of a double wall construction. Said blank has along its length a series of spaced transverse score lines 69. Centrally of the central score line there is a diamond shaped cut out slot 71 formed therein. The head rest blank is adapted to be folded as shown in FIG. 6, to include a pair of converging sides 73 and the base walls 75 and 77. A pressure-sensitive adhesive 79 is applied to one of the surfaces of each of the base walls and protected by the tear off strip 37.

With the head rest formed to the triangular shape shown in FIG. 6, one of the layers of pressure-sensitive adhesive 79 will bear against the bottom wall of the container or the adjacent wall of the intermediate liner mat 81 also formed of a double wall corrugated cardboard. Said liner mat is of the same dimension as the bottom wall 24 and cooperatively and slightly engages the corresponding bottom edges of the corresponding side and end walls and is provided as a reinforcement for the assembled casket construction. Said mat is of double wall corrugated cardboard of a 350 pound strength.

Upon the outer surfaces of the respective blanks, there is applied as a part thereof a layer of paper which has a wood grain appearance as at 83 to, thus, simulate a wooden casket, or any other desired color such as natural, white, black or brown.

The triangular opening 71 shown in the blank in FIG. 7 thus provides the notch of triangular shape shown in the head rest 17, FIGS. 2 and 5.

Having described our invention, reference should now be had to the following claims.

We claim:

1. In a casket including a container and a removable cover securable thereover; said container and cover comprising:

elongated container and cover blanks made of double-wall corrugated cardboards;

each blank being scored and precut to define when folded for said container and cover respectively, top and bottom walls;

upturned and downturned outwardly tapered side walls;

upturned and downturned outwardly tapered end walls;

and foldable inwardly directed flaps on all said end walls; said flaps registering with the corresponding side walls of the container and cover respectively;

a layer of adhesive material between said flaps and corresponding side walls, providing a unit assembly carton and cover;

said cover side and end walls overlying and supportably and retainingly engaging the corresponding container side and end walls;

and means interlocking said cover with said container;

said means comprising a series of formed slotted portions upon the interior of the cover side and end walls intermediate their ends forming anchor stops therein;

and a corresponding series of cover anchoring tabs extending downwardly and outwardly from the edge of said container end and side walls; snap fitted into and interlocked with said cover anchor stops respectively.

2. In the casket of claim 1, said adhesive layer overlying the inner surfaces of said tabs, and a removable protective strip over said adhesive layer.

3. In the casket of claim 2, an additional adhesive layer with removable protective strip upon corresponding portions of said container and cover side walls, said tabs, end and side walls when assembled and secured together forming a moisture-tight container.

4. In the casket of claim 1, a head rest within said container and mounted upon its bottom wall adjacent one end thereof transversely of its side walls, said head rest being hollow and of triangular in cross section, having a base and converging sides, there being centrally disposed triangular notches formed within said sides.

5. In the casket of claim 4, an adhesive layer between said base and container bottom wall.

6. In the casket of claim 4, said head rest including a retangular strip of corrugated cardboard, there being a series of transverse spaced score lines along its length defining when folded into triangular shape, a pair of overlapping base walls;

and a layer of adhesive upon one of said base walls for securing said base walls together.

7. In the casket of claim 6, there being a diamond-shaped slotted portion centrally of the central of said score lines providing said notches.

8. In the casket of claim 4, an elongated double wall reinforcement liner of corrugated cardboard, of rectangular shape corresponding to said container base, snugly interposed between the corresponding container side and end walls, and interposed between said bottom wall and head rest.

9. In the casket of claim 1, each blank including an outer sheet, having a wood grain appearance.

10. In the casket of claim 1, each blank having an outer sheet of a predetermined color including natural colors.

* * * * *